US012790072B2

(12) United States Patent
McCarthy et al.

(10) Patent No.: US 12,790,072 B2
(45) Date of Patent: Nov. 10, 2026

(54) UNIVERSAL QUICK CONNECT PALLET ATTACHMENT

(71) Applicant: RAYTHEON COMPANY, Waltham, MA (US)

(72) Inventors: Eleanor McCarthy, Frederick, MD (US); Andrew M. Gray, Marlborough, MA (US); Wayne M. Choquette, Rochdale, MA (US)

(73) Assignee: RAYTHEON COMPANY, Waltham, MA (US)

( * ) Notice: Subject to any disclaimer, the term of this patent is extended or adjusted under 35 U.S.C. 154(b) by 67 days.

(21) Appl. No.: 18/829,954

(22) Filed: Sep. 10, 2024

(65) Prior Publication Data

US 2026/0077906 A1 Mar. 19, 2026

(51) Int. Cl.
*B65D 19/38* (2006.01)
*B65D 19/00* (2006.01)

(52) U.S. Cl.
CPC ..... *B65D 19/38* (2013.01); *B65D 19/0008* (2013.01); *B65D 2519/00288* (2013.01); *B65D 2519/00547* (2013.01); *B65D 2519/00805* (2013.01)

(58) Field of Classification Search
CPC ..... B65D 19/38; B65D 19/0008; B65D 19/00288; B65D 2519/00805
USPC ..... 108/51.11
See application file for complete search history.

(56) References Cited

U.S. PATENT DOCUMENTS 3,429,536 A * 2/1969 Weingarten ..... B65D 88/14 248/346.02
3,622,114 A * 11/1971 McIntire, Jr. ..... B65D 19/0002 248/346.02
3,703,870 A * 11/1972 Walton ..... B65D 88/129 108/51.11
4,046,347 A * 9/1977 Bryan ..... B65D 19/38 248/346.02
4,284,013 A 8/1981 Davidson
5,860,369 A * 1/1999 John ..... B65D 19/0075 108/56.1
6,095,348 A * 8/2000 Karashima ..... A47F 5/103 211/175
6,308,642 B1 * 10/2001 Branam ..... B65D 19/0002 248/346.02
6,561,739 B1 * 5/2003 Garala ..... B62D 21/12 410/35
6,923,606 B2 8/2005 Fehrle et al.
(Continued)

*Primary Examiner* — Daniel J Troy
*Assistant Examiner* — Timothy M Ayres
(74) *Attorney, Agent, or Firm* — Millen, White, Zelano & Branigan P.C.; William F. Nixon

(57) ABSTRACT

A pallet attachment is disclosed. The pallet attachment is used to interconnect a universal cargo pallet with an accessory. The pallet attachment includes a first body portion having at least one shoulder bolt recess, each of which has a flat bottom surface and a hole for receiving a shoulder bolt. The pallet attachment further includes a step-down second body portion having a plurality of attachment holes. When in use, the first body portion is placed on top of rails of the universal cargo pallet and is secured to the top of the rails by engaging at least one tie-down ring of the universal cargo pallet with the at least one should bolt of the pallet attachment. The attachment holes are used to receiving attachment elements of the accessory.

9 Claims, 8 Drawing Sheets

(56) References Cited

U.S. PATENT DOCUMENTS

| | | | | |
|---|---|---|---|---|
| 7,930,865 | B2 * | 4/2011 | Barlow | E04F 15/087 52/741.11 |
| 8,596,207 | B2 * | 12/2013 | Dubois | B65D 19/0002 108/57.26 |
| 9,169,657 | B1 * | 10/2015 | Marek | E04F 15/02177 |
| 9,228,361 | B2 * | 1/2016 | Brisendine | B65D 19/38 |
| 10,293,974 | B1 | 5/2019 | Scheer et al. | |
| 10,549,884 | B1 | 2/2020 | Saggio et al. | |
| 10,939,676 | B1 * | 3/2021 | Harter | E04G 5/10 |
| 10,969,096 | B2 * | 4/2021 | Fuller | E01C 5/003 |
| 11,427,379 | B2 * | 8/2022 | Fitzgerald | B65D 19/004 |
| 2005/0028475 | A1 * | 2/2005 | Barlow | A63B 69/3661 52/578 |
| 2009/0025616 | A1 * | 1/2009 | Merrill | B65D 88/14 264/145 |
| 2009/0116925 | A1 * | 5/2009 | Juchniewicz | B65D 19/0002 410/52 |
| 2009/0139160 | A1 * | 6/2009 | Hill | B32B 9/005 52/177 |
| 2014/0261102 | A1 * | 9/2014 | Kuo | B65D 19/44 108/55.3 |

* cited by examiner

UNIVERSAL QUICK CONNECT PALLET ATTACHMENT

This invention was made with Government support under FA8705-14-0001 awarded by the United States Air Force. The Government has certain rights in the invention.

FIELD OF THE INVENTION

The present disclosure relates to a universal quick connect pallet attachment. More particular, the present disclosure relates to a universal quick connect pallet attachment using a gravity assisted locking feature.

DESCRIPTION OF THE RELATED ART

Current solutions for locking ramps, bridges, or any connections to the surface of the pallet are typically one-offs, or one time disposable options and at times can present safety hazards. Typical solutions include plywood ramps made onsite with materials on hand as opposed to a system traveling with the pallet that can consistently attach and lock to the pallet in a repeatable manner.

An adaptor connects pallets together which increases stability during transportation and reduces the risk of shifting or tipping. Linked pallets can be moved and loaded as a single unit, streamlining logistics operations. Some cargo may require larger surface areas than a single pallet provides. By connecting pallets, larger cargo items can be accommodated. Connecting pallets can maximize the use of available cargo space, especially in aircraft or other transport vehicles with specific dimensional constraints. The adaptor, however, utilizes the existing 463L pallet rings to interconnect two pallets, but requires two pallets or tie down ring interface equivalents to bridge the gap, without a smooth surface. Additionally, it is located only around the tie-down rings meaning most of the pallet edges are not covered.

SUMMARY

The present disclosure is directed to, in a first aspect, a pallet attachment for connecting a pallet and an accessory. The pallet attachment includes a first body portion adapted to rest on a top surface of at least one rail of the pallet. The first body portion includes, on a top surface thereof, at least one shoulder bolt located in one shoulder bolt recess for receiving and engaging with at least one pallet tie-down ring of the pallet, wherein the at least one shoulder bolt is penetrable through a bottom surface of the first body portion to contact with the top surface of the at least one rail of the pallet. The pallet attachment further includes a second body portion that is a step-down ledge from the first body portion, has at least one attachment element adapted to receive an attaching part of the accessory.

The first body portion of the pallet attachment includes at least two shoulder bolts, each of the shoulder bolts is capable of rotating down to contact the top surface of the at least one rail of the pallet.

When using to interconnect the pallet and the accessory, a bottom surface of the first body portion is placed on the top surface of the at least one rail of the pallet, and two corners of the bottom surface that are attached to the pallet are chamfered.

In addition to the embodiment disclosed above, the at least one shoulder bolt of the first body portion is located under the at least one tie-down ring when the first body portion is placed on the top surface of the at least one rail of the pallet.

Further, according to the disclosed embodiments, the at least one tie-down ring is engaged with the at least one shoulder bolt within the shoulder bolt recess for securing the at least one shoulder bolt on the top surface of the at least one rail of the pallet.

In addition to the embodiments disclosed above, the at least one attachment element of the second body portion is an attachment hole, and the at least one attachment part of the accessory is a pin.

Further, according to the disclosed embodiments, the at least one attachment element of the second body portion is a upward protrusion, and the at least one attachment part of the accessory is a through hole.

In addition to the embodiments disclosed above, the top surface of the first body portion is substantially at a same level of a top surface of the pallet when the pallet attachment is resting on the top surface of the at least one rail of the pallet.

In yet another embodiment, the present disclosure is directed to, in a second aspect In yet another embodiment, the present disclosure is directed to, in a second aspect, a pallet attachment for connecting a cargo pallet and an accessory. The pallet attachment includes a first body portion comprising at least one shoulder bolt recess and at least one shoulder bolt on a top surface of the first body portion, each of at least one shoulder bolt recess has a flat bottom surface and a hole for receiving one of the at least one shoulder bolt. The bottom surface of the at least one shoulder bolt recess is lower than the top surface of the first body portion, and the at least one shoulder bolt recess and the at least one shoulder bolt are used for receiving and engaging with at least one pallet tie-down ring included in the pallet. The pallet attachment further includes a second body portion that is a step-down ledge from the first body portion extended from a length direction of the first body portion, having at least one attachment hole on a surface of the second body portion adapted to receive an attaching element of the accessory.

In addition to the embodiments disclosed above, the first body portion includes two side walls on width directions, that when in use, the first body portion is placed on a top surface of at least one rail of the pallet with the side walls sitting on the top surface of at least one rail. The at least tie-down ring of the pallet is engaged with the at least one shoulder bolt for security.

In addition to the embodiments disclosed above, the first body portion is a pocket-type with two side walls in its width direction, and two bottom corners of the two side walls that are attached to the pallet are chamfered.

In addition to the embodiments disclosed above, the first body portion includes at least two shoulder bolts, each of the shoulder bolts is capable of rotating down to contact the top surface of the at least one rail of the pallet.

Further, according to the embodiments disclosed above, the at least one shoulder bolt is located under the at least one tie-down ring when the first body portion is placed on the top surface of the at least one rail of the pallet.

In addition to the embodiments disclosed above, the at least one tie-down ring is engaged with the at least one shoulder bolt within the at least one shoulder bolt recess for securing the at least one shoulder bolt on the top surface of the at least one rail of the pallet.

Further, according to the embodiments disclosed above, a top surface of the first body portion is substantially at a same level of a top surface of the cargo pallet when the pallet attachment is resting on the top surface of the at least one rail of the pallet.

In yet another embodiment, the present disclosure is directed to, in a third aspect, a pallet assembly. The pallet assembly includes a cargo pallet that has a platform and a plurality of rails on four sides of the platform, and a plurality of tie-down rings located between every other two rails. The pallet assembly also includes a pallet attachment for attaching to the cargo pallet for locking and extending a pallet surface the pallet surface. The pallet attachment includes a top surface having at least one shoulder bolt recess and at least one shoulder bolt, each of at least one shoulder bolt recess has a flat bottom surface and a hole for receiving one of the at least one shoulder bolt. The bottom surface of the at least one shoulder bolt recess is lower than the top surface, and the at least one shoulder bolt recess and the at least shoulder bolt are used for receiving and engaging with at least one pallet tie-down ring included in the pallet. The pallet attachment further includes a step-down ledge having at least one attachment holes adapted to engage with at least one attachment element of an accessory.

According to the embodiments disclosed above, when in use, the pallet attachment is placed on a top surface of at least one of the plurality of rails of the pallet with the flat bottom surface of the at least one shoulder bolt recess sitting on the top surface of the at least one rail, and the at least tie-down ring of the pallet is engaged with the at least one shoulder bolt for security.

In addition to the embodiments disclosed above, the at least one shoulder bolt is capable of rotating down to contact the top surface of the at least one of the plurality of rails of the pallet.

Further, the at least one tie-down ring is engaged with the at least one shoulder bolt within the shoulder bolt recess for securing the at least one shoulder bolt on the top surface of the at least one of the plurality of rails of the pallet.

In addition to the embodiments disclosed above, the top surface of the pallet attachment is substantially at a same level of a top surface of the cargo pallet and a top surface of the accessory when the pallet attachment is resting on the top surface of the at least one of the plurality of rails of the pallet and the at least one attachment element of the accessory is attached to the at least one attachment hole of the pallet attachment.

BRIEF DESCRIPTION OF THE DRAWINGS

Implementations of the inventive concepts disclosed herein may be better understood when consideration is given to the following detailed description thereof. Such description refers to the included drawings, which are not necessarily to scale, and which some features may be exaggerated and some features may be omitted or may be represented schematically in the interest of clarity. Like reference numerals in the drawings may represent and refer to the same or similar element, feature, or function. In the drawings.

DETAILED DESCRIPTION OF THE INVENTION

Figure 2:
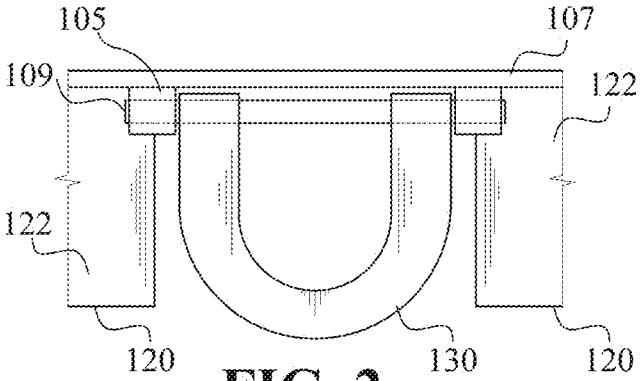
FIG. 2 illustrates an enlarged view of a tie-down ring of the cargo pallet of FIG. 1.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of the embodiments of the inventive concepts, numerous specific details are set forth in order to provide a more thorough understanding of the inventive concepts. It will be apparent to one skilled in the art, however, having the benefit of the instant disclosure that the inventive concepts disclosed herein may be practiced without these specific details.

As used herein, a letter following a reference numeral is intended to reference an embodiment of the feature or element that may be similar, but not necessarily identical, to a previously described element or feature bearing the same reference numeral, such as 1, 1*a*, or 1*b*. Such shorthand notations are used for purposes of convenience only, and should not be construed to limit the inventive concepts disclosed herein in any way unless expressly stated to the contrary.

Moreover, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant disclosed concepts. This is done merely for convenience and to give a general sense of the inventive concepts, and "a" and "an" are intended to include one or at least one and the singular also includes plural unless it is obvious that it is meant otherwise. It will be further understood that the terms "comprises" or "comprising," when used in this specification, specify the presence of stated features, integers, steps, operations, elements, or components, but do not preclude the presence or addition of one or more other features, integers, steps, operations, elements, components, and/or groups thereof.

The 463L pallet (also called the HCU-6/E or 463L Master Pallet) is a standardized pallet used for transporting military air cargo. The 463L pallet system is equipped for locking pallets into cargo aircraft rail systems, but has no means of locking to the surface of the pallet for ramps, bridges, or any connections between pallets on the flight line. Additionally, the aircraft rail design has an outboard tooth, making the pallet non-planar for loading/unloading.

The disclosed embodiments are directed towards an attachment which is adapted to quickly interconnect a universal 463L cargo pallet with an accessory such as, for example, a ramp or bridge. The attachment locks into and attaches to the 463L cargo pallet via gravity. The locking feature ensures during loading/unloading equipment that there is no movement or gap between the ramp/attachment and the pallet surface. The universal 463L cargo pallet attachment utilizes existing features of the 463L cargo pallet, specifically the 7500 lb rated tie-down rings which are typically used for cargo net, as the interlocking of the attachment. The attachment also levels and extends the pallet surface beyond the existing pallet rail lip. This same attachment could be used on two pallets to create a bridge interlocking of pallets for shipping. The attachment uses a combination of gravity and slotting to rest across the rail feature of the pallet to both lock and extend the pallet surface. The attachment also has a standard 2"-hole pattern for modularity across both the short and long side of the pallet, as well as allow for placement in any location.

The attachment in accordance with the disclosed embodiments will be described in great details in FIG. 4 and below.

The 463L cargo pallet (15) is a standardized military pallet used by the United States Department of Defense (DoD) and NATO countries for transporting cargo by air, sea, and ground. It is widely used for logistical purposes, especially for loading and unloading military aircraft quickly and efficiently. The 463L pallet is also known as an HCU-6/E or Master Pallet. It was designed to be loaded and offloaded on today's military airlifters as well as many civilian Civil Reserve Air Fleet (CRAF) cargo aircraft. The 463L pallet system allows for efficient loading and unloading without the need for specialized handling equipment. Its standardization ensures interoperability and ease of use across different military branches and allied forces.

The inside of a 463L pallet is typically hollow. These pallets are constructed using lightweight materials such as aluminum or composite materials to keep weight down while maintaining strength and durability. The structure is typically an open framework with cross beams and support structures, allowing for easy handling and transportation of cargo. This design also helps to reduce overall weight, making the pallets suitable for air transport aboard military aircraft.

The standard dimensions of a 463L pallet are 108 inches (9 feet) in length, 88 inches (7 feet 4 inches) in width, and 2.25 inches in height. However, there are variations depending on specific requirements and modifications.

Figure 3:
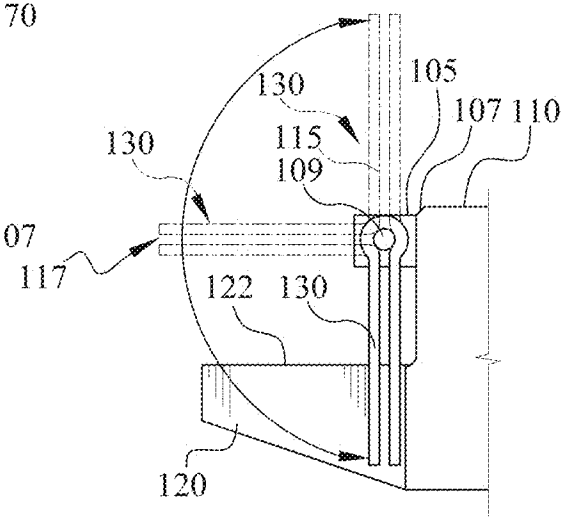
FIG. 3 illustrates an enlarged cross-sectional side view of the tie-down ring of FIG. 2.
Figure 1:
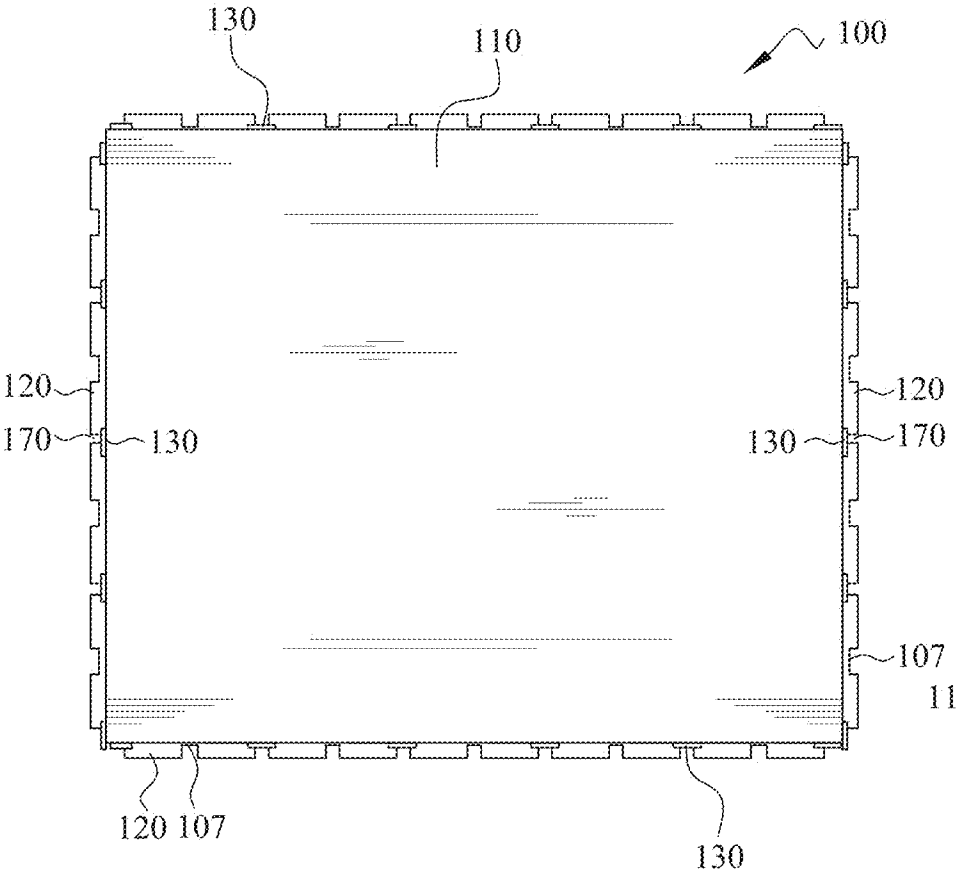
FIG. 1 illustrates a top view of a cargo pallet.

A standard 463 pallet 100 is illustrated in FIGS. 1-3. FIG. 1 is a top view of pallet 100. FIG. 2 is an enlarged view of a tie-down ring 630 installed on the sides of pallet 100. FIG. 3 is illustrated diagram of the tie-down ring 630 showing the tie-down ring can pivotally move up and down.

As shown in FIG. 1, the pallet 100 is composed of several parts. A platform 110 is the main flat surface of the pallet where a cargo (not shown) is placed. Rails 120 are metal bars spaced along the peripheral edges of the pallet to secure cargo. A 463L pallet typically has 22 longitudinal rails along the length of the pallet and 10 transverse rails along the width. These rails are spaced evenly along the length and width of pallet 100. Typically, every other two rail has a tie-down ring 130 between them, providing multiple tie-down points for securing cargo. Tie-down rings 130 extend from an upper portion of a platform side edge 107 and are located in spaces 170 between the rails 120. Top surfaces 122 (see FIG. 2) of the rails 120 are at a level just beneath the level of the tie-down rings 130.

Platform 110 of pallet 100 itself is typically made of aluminum or other lightweight materials, and the rails are designed to provide structural support and securement for the cargo being transported on the pallet. The dimensions of rails 120 are approximately 2.16 inches (5.48 cm) wide and approximately 2.25 inches (5.72 cm) tall. The top of rail 120 on a 463L pallet refers to the uppermost edge of the protruding metal rails that form the perimeter of the pallet platform. The distance between the top of the rail 122 and the platform of the pallet 100 can vary slightly depending on the specific design and manufacturer of the pallet. However, typically, this distance is approximately 2.5 inches (6.35 centimeters). Typically, rail 120 extends approximately 3 to 4 inches (7.62 to 10.16 centimeters) away from the edge 107 of pallet 100. This extension provides structural support and securement for the cargo being transported on the pallet while still allowing forklifts and other handling equipment to access the pallet from the sides. These dimensions are standardized to ensure compatibility with the various handling and transportation systems used by military aircraft and ground vehicles.

Pallet 100 may contain rollers (not shown) which are attached to the underside of the pallet to facilitate loading and unloading. However, not all 463L pallets have rollers. The 463L pallet can come with or without rollers. The pallets without rollers are typically used for ground transportation or when loading onto aircraft that do not require roller systems for cargo handling. However, some versions of the 463L pallets do have roller systems, which facilitate easier movement and handling of cargo, particularly when loading and unloading from certain aircraft or material handling equipment. Some pallets may also be used with dunnage 118 (shown in FIG. 6) or 4×4 underneath in order to increase the height of the pallet.

FIG. 2 is an enlarged view of tie-down ring 130 of pallet 100. Tie-down ring 130 is a metal ring spaced along edge 107 of pallet 100 between rails 120. They are used to secure cargo with straps or chains. A standard 463L pallet typically has 22 tie-down rings, evenly spaced along the edges of the pallet. These rings are strategically positioned to provide optimal securing points for cargo using straps or chains. The spacing between the tie-down rings is approximately 18 inches apart. This configuration allows for flexibility in securing different types and sizes of cargo while ensuring stability and safety during transport. While dimensions can vary slightly depending on the manufacturer and specific model, a common size for the tie-down rings on a 463L pallet is approximately 1.25 inches (3.18 cm) in diameter. In addition to the tie-down rings, some 463L pallets have net attachments (not shown.) These attachments may include hooks, loops, or clips designed to connect with the mesh of cargo nets. The nets can then be stretched over the pallet and attached to these points, ensuring a secure connection.

In certain cases, custom modifications may be made to the pallet to better integrate it with cargo nets. This could involve welding additional attachment points or modifying existing structures to better accommodate the nets used in a particular aircraft or operation.

FIG. 3 illustrate a cross-sectional side view of tie-down ring 130 taken on line 3-3 of FIG. 2. As shown, tie-down ring 130 is located close to the upper portion of side edge 107 supported by pintles 109 and gudgeon members 105 and is in a space 170 between two rails 120. Tie-down rings 130 may be pivotally connected to pintles 109 so that they can be moved down when not in use or for storage and move up to a proper position to attach with an attachment, such as upright position 115 and an extended position 117. Tie-down rings 130 may be made of steel for strength and durability.

There are current commercially available ramps designed to adapt to 463L pallets for loading and unloading cargo. These ramps are typically engineered to facilitate the movement of vehicles, equipment, or other cargo onto and off of 463L pallets. The design of these ramps can vary depending on the specific requirements of the loading environment and the type of cargo being transported. Some ramps may be foldable or collapsible for easier storage and transportation when not in use. They may also feature adjustable height and angle settings to accommodate different loading scenarios. These ramps are commonly used in military logistics operations where vehicles or heavy equipment need to be transported via aircraft or other means using 463L pallets as a standardized platform.

Figure 4:
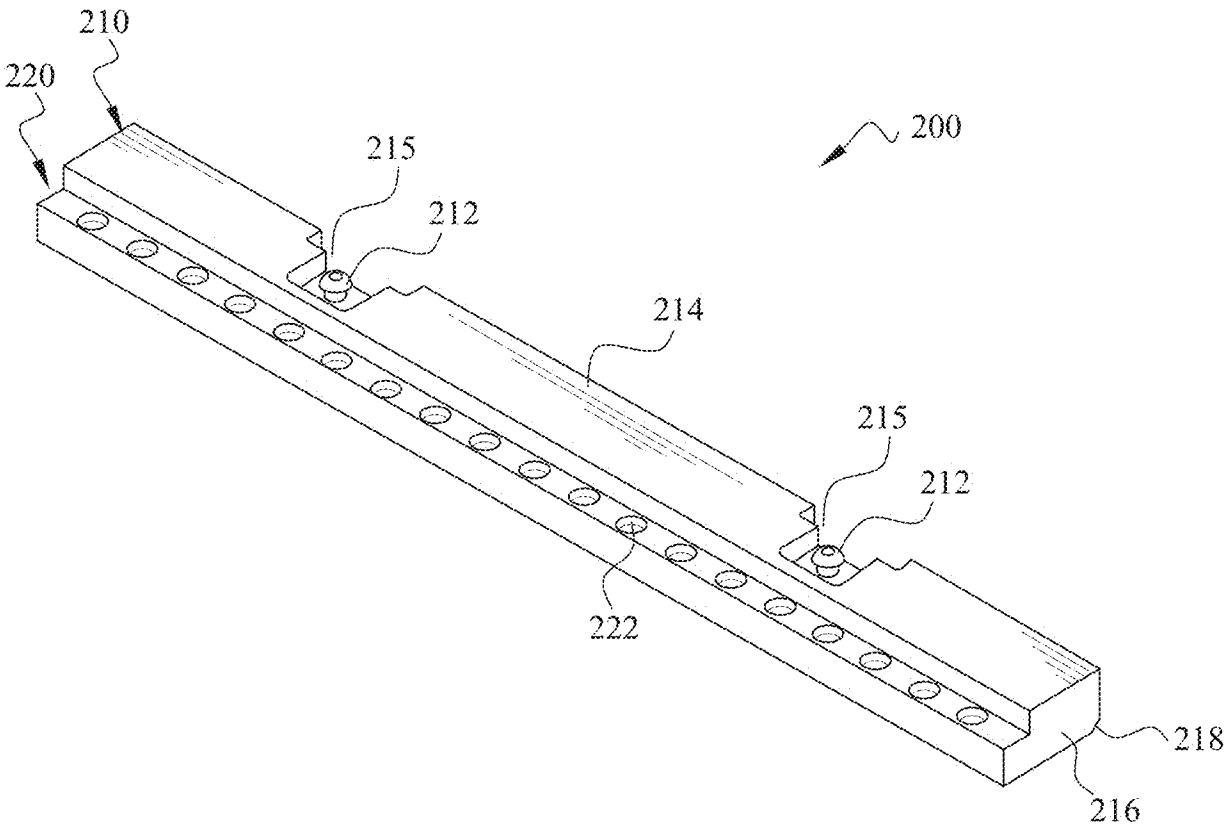
FIG. 4 illustrates a perspective view of a pallet attachment that is attachable to a cargo pallet in accordance with the disclosed embodiments.

FIG. 4 illustrates a perspective view of a pallet attachment 200 in accordance with the disclosed embodiments. Pallet attachment 200 is adapted to quickly interconnect pallet 100 with an accessory, such as a ramp or a bridge. The pallet attachment is attached to pallet 100 using a gravity assisted locking feature. No other tools are need to attach pallet attachment 200 to pallet 100. Pallet attachment 200 provides a smooth interconnection with the ramps or bridge and pallet 100, leaving no gap or movement between the ramp/the attachment and the surface of pallet 100 for loading and unloading equipment.

Pallet attachment 200 is in a shape of a rectangular prism and includes a first body portion 210 and a second body portion 220 extending along the length of pallet attachment 200. The height of first body portion 210 is larger than that of second body portion 220 so that second body portion 220 is step-down from first body portion 210. Second body portion 220 includes a plurality of holes or attachment holes 222 for attaching with a ramp (300, shown in FIG. 6.) Each of the plurality of holes 222 has a standard 2"-hole pattern for modularity across both the short and long side of the pallet, as well as allow for placement in any location.

Figure 6:
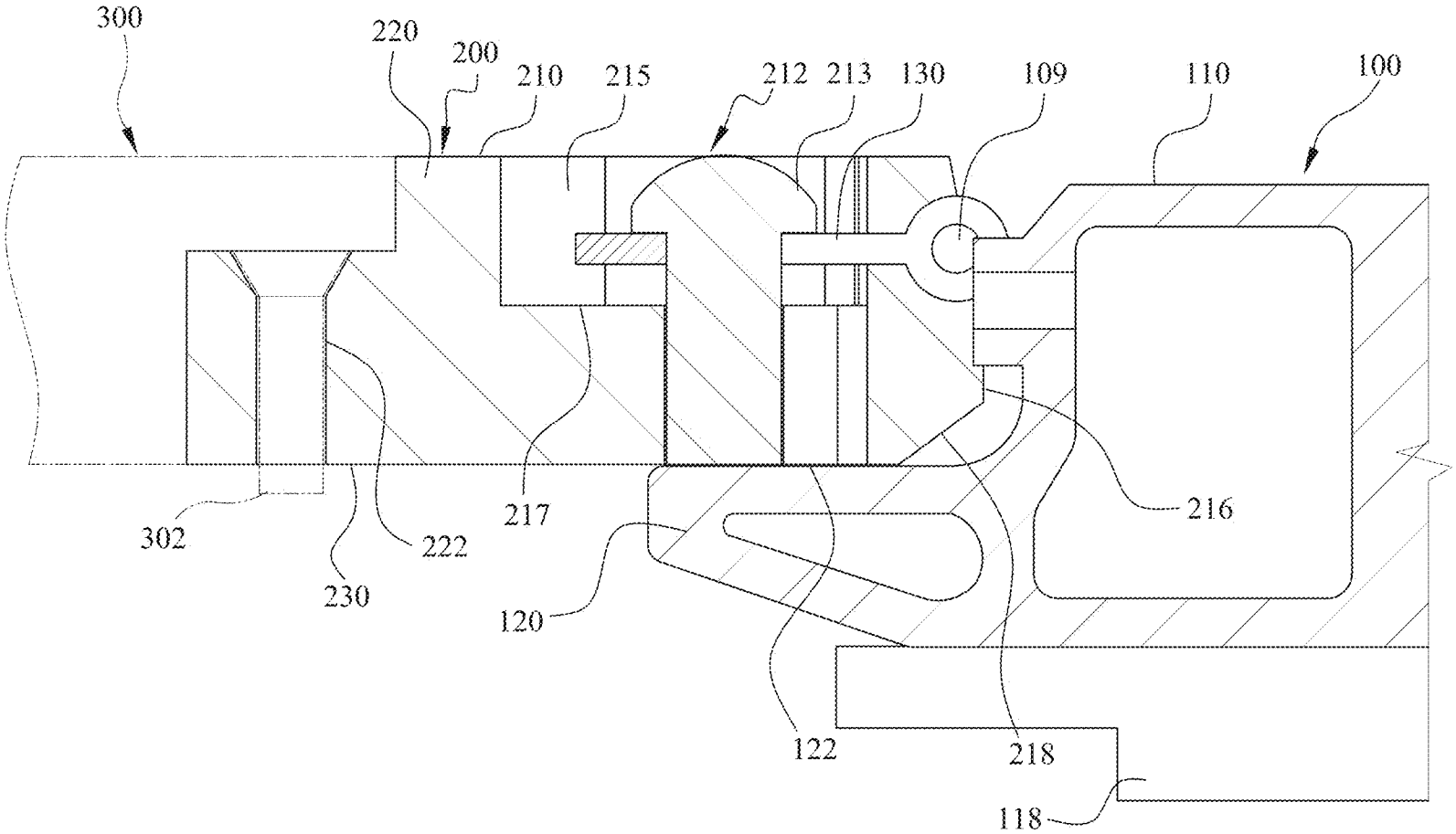
FIG. 6 illustrates a cross-sectional side view of an embodiment in which a pallet attachment of the disclosed embodiments interconnects an accessory and a cargo pallet.

First body portion 210 includes a plurality of bolts 212, or shoulder bolts 212, spaced apart in a pattern corresponding to the locations of tie-down ring 130 of pallet 100. The plurality of bolts 212 are located in bolt recess areas 215 on a top surface 240 of first body portion 210. Each of the bolt recess areas 215 has a hole 213 in the middle so that each of the plurality of bolts 212 can be screwed down or rotated down through hole 213. In certain embodiments, the bolts are spaced about 20 inches apart. When in use, pallet attachment 200 is placed, in its longitudinal direction, on the top of rails 120 of pallet 100 with the plurality of bolts 212 located under tie-down rings 130 in an extending position shown as direction 117 of FIG. 3. After placing pallet attachment 200 on the top of rails 120 of pallet 100, tie-down rings 130 may be placed down into bolt recess areas 215 to be below a top of bolts 122 and the plurality of bolts 212 can be rotated down through hole 213 of bolt recess areas 215 to contact with top surfaces 122 of trails 120. Pallet attachment 200 slides against bolts 212 to lock with tie-down rings 130 and top surfaces 122 of rails 120 of pallet 100, as shown in FIG. 6. It is noted that tie-down rings 130 are typically used for cargo net. In accordance with the disclosed embodiment, tie-down rings 130 is also used as the interlocking tools of the pallet attachment 200.

Pallet attachment 200 of the disclosed embodiments uses a combination of gravity and slotting to rest across the rail feature of pallet 100 to achieve not only a function of locking with pallet 100 but also a function of extending the pallet surface. Pallet attachment 200 also levels and extends the pallet surface beyond the existing pallet rail lip. Further, pallet attachment 200 may be used on two pallets 100 to create a bridge interlocking of pallets for shipping.

Figure 5:
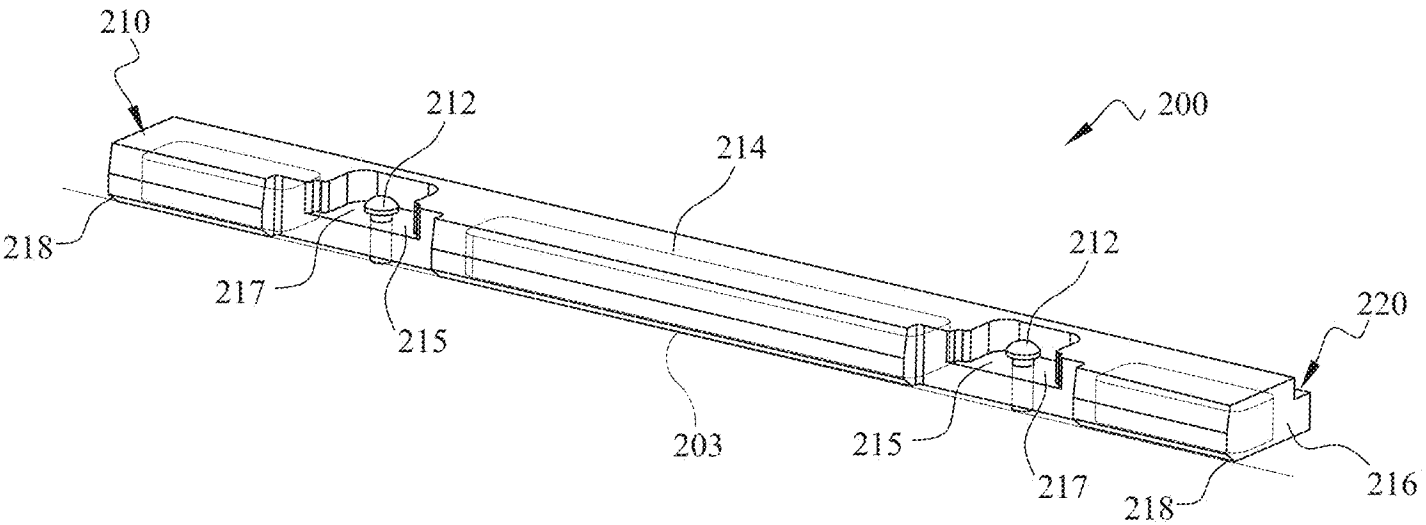
FIG. 5 illustrates another perspective view of the pallet attachment of FIG. 4 showing the back of the pallet attachment.

FIG. 5 illustrates another view of pallet attachment 200 showing the back of the pallet attachment. In the disclosed embodiment, first body portion 210 is in a pocket-style including two side walls 216 but does not have a bottom wall. Each of shoulder bolt recesses 215 includes a bottom surface 217 that is lower than top surface 240 of first body portion 210. The depth of shoulder bolt recess 215 may be longer than the step-down distance of second body portion 220 from top surface 214 of first body portion 210, but is shorter than the height of side walls 216. Therefore, when bottom surface 230 (a virtual surface) of first body portion 210 is placed upon the top surfaces 122 of rails 120, side walls 230 of first body portion 210 will be seated upon and supported by rail top surfaces 122. Further, the lower edges of side walls 21 facing rails 120 may have chamfered edges 218 to allow for ease in placing pallet attachment 200 to connect with pallet 100. Shoulder bolt recess areas 215 allow space for the tie-down rings 130 to engage the shoulder bolt 212. Should bolts 212 that penetrates through hole 213 of bolt recess areas 215 would contact and secure pallet attachment 200 in place. It is important that tie-down rings 130 are loosely engaged within shoulder bolt recess areas 215 to allow some flexibility of movement between accessary 300 and pallet attachment 200. Further details of the interconnection between pallet attachment 200, pallet 100, and accessary 300 will be described in greater details in FIGS. 6 and 7.

FIG. 6 illustrates a side cross-sectional view of an embodiment wherein pallet attachment 200 interconnects an accessory 300 and pallet 100. Accessory 300 may be a ramp with attachment elements, such as pins 302 on one side or both sides thereof. As shown in FIG. 6, pins 302 (only one shown in FIG. 6) are used to extend through attachment holes 222 so that accessory 300 connects with pallet attachment 200. Side walls 216 and of shoulder bolts 212 of pallet attachment 200 rest upon rail top surface 122 of pallet 100. In this embodiment, top surface 214 of pallet attachment 100 is approximately flush with the top surface of platform 110 of pallet 100.

As shown in FIG. 6, when pallet attachment 200 are properly placed on top surface 122 of rails 120, tie-down rings 130 are pushed down to engage into shoulder bolt recesses 215 and surrounds shoulder bolts 212. Shoulder bolts 212 rotates down to touch top surfaces 122 of rails 120 of pallet 100 with tie-down rings 130.

Figure 7:
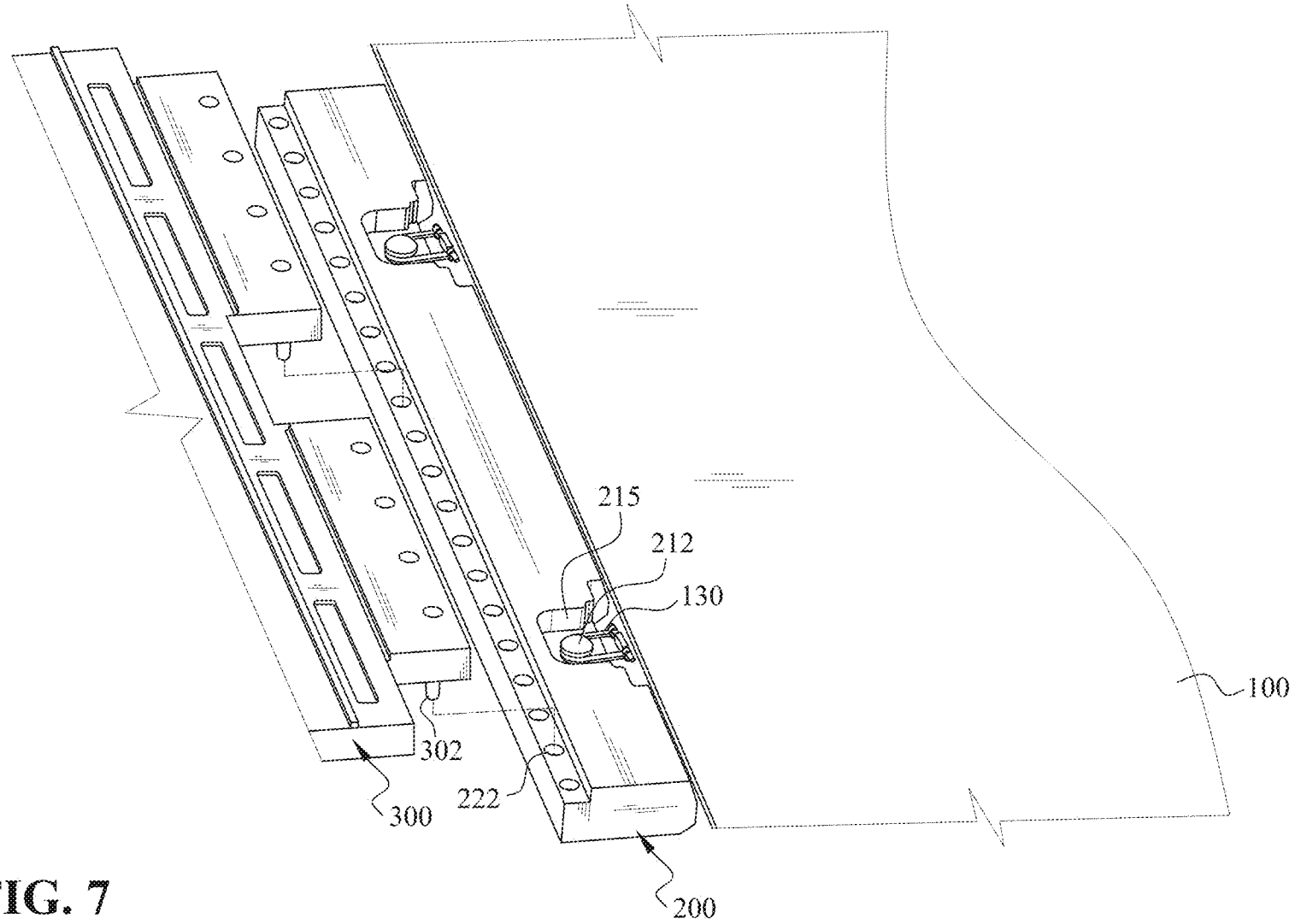
FIG. 7 illustrates an enlarged view showing how the pallet attachment of FIG. 4 attaches to a cargo pallet and an accessory in accordance with the disclosed embodiment.

FIG. 7 illustrates a partial enlarged view of the embodiment shown in FIG. 6. As shown, first body portion 210 of pallet attachment 200 is locked on pallet 100 with the combination of shoulder bolts 212 and tie-down rings 130. Further, accessory 300 is attached to pallet attachment 200 by engaging pins 302 of accessary 300 into attachment holes 222 of second body portion 220 of pallet attachment 200. That is, attachment holes 222 and shoulder bolts 212 of pallet attachment 200 are designed to allow pallet attachment 200 to rest across the rail feature of pallet 100 by gravity and slotting feature. No additional tools are needed to interconnect pallet attachment 200, pallet 100, and accessory 300.

In the embodiments shown in FIGS. 4-7, pallet attachment 200 includes attachment holes 222 in second body portion as attachment elements to connect with accessory 300. The attachment elements of the disclosed pallet attachment, however, are not limited to attachment holes. Various embodiments of the pallet attachment are shown in FIGS. 8 and 9 for instance.

Figure 8:
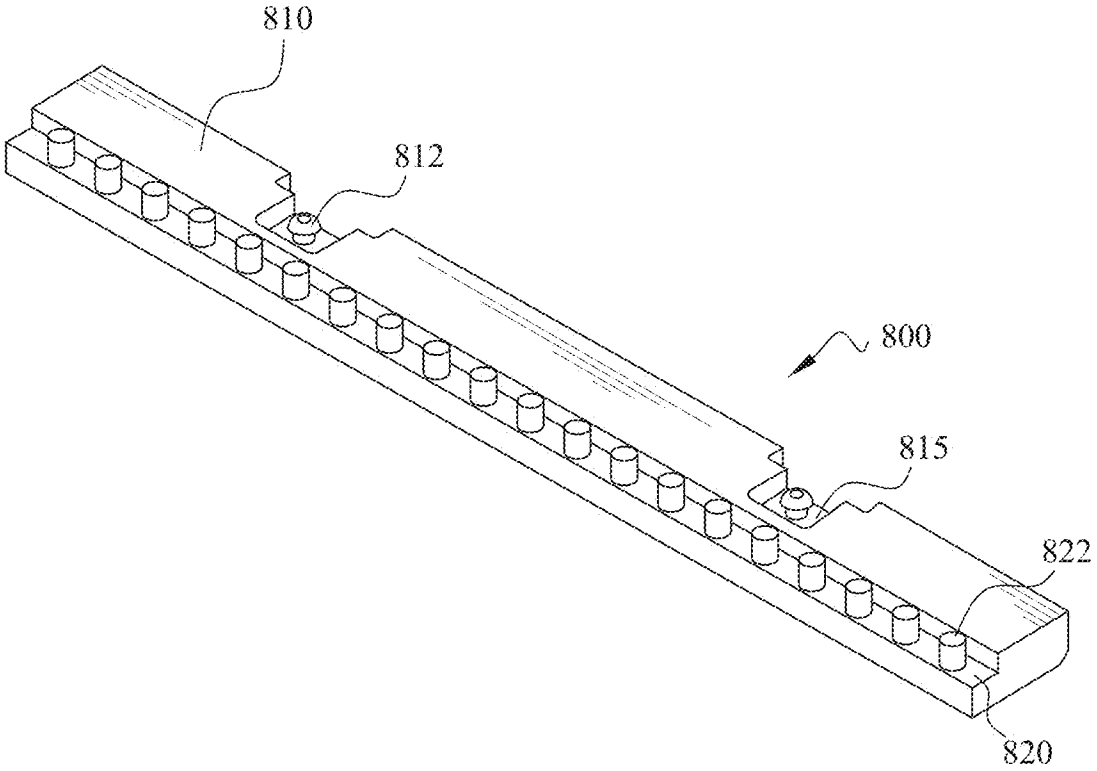
FIG. 8 illustrates a perspective view of a various pallet attachment in accordance with the disclosed embodiments.
Figure 9:
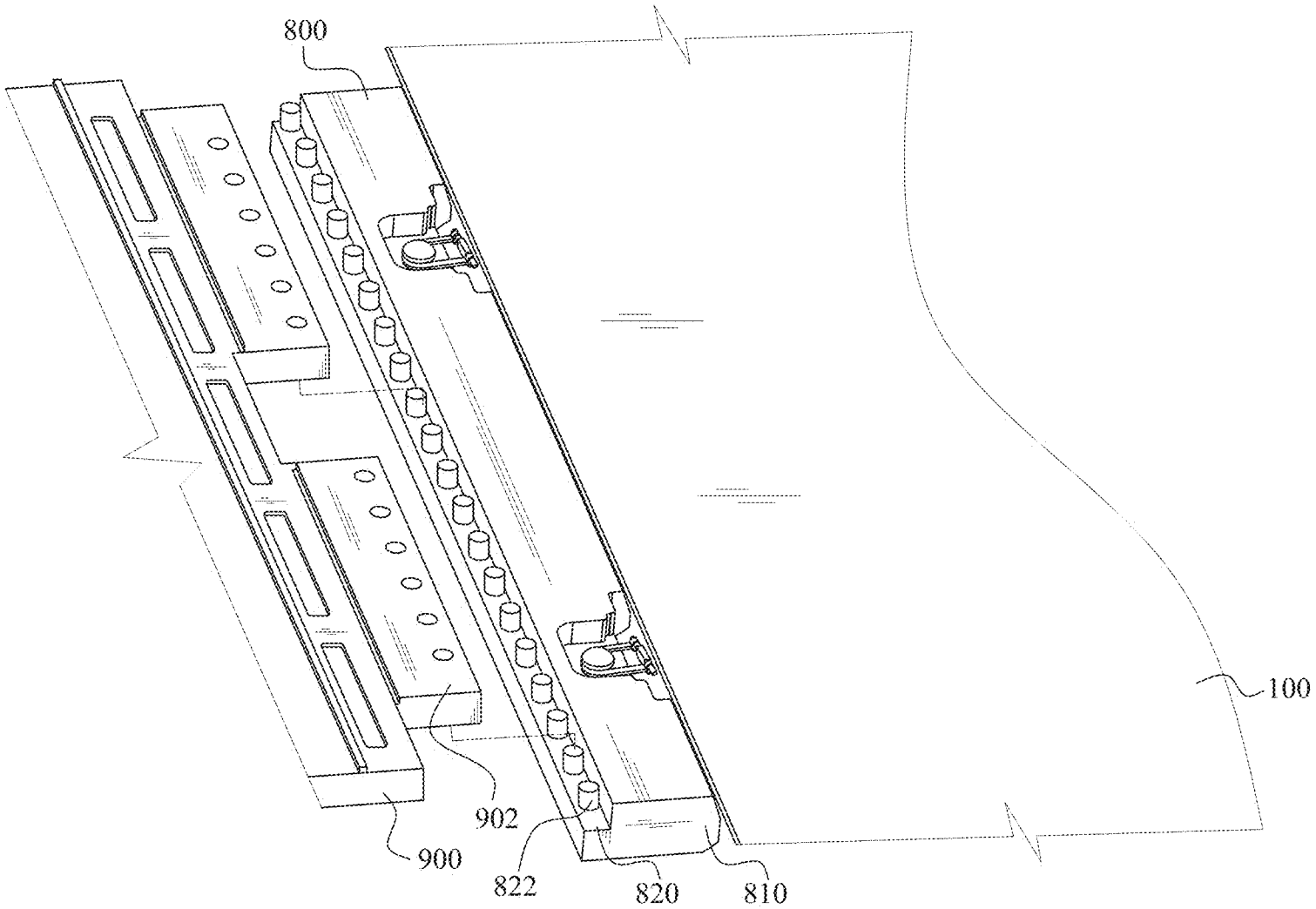
FIG. 9 illustrates an enlarged view showing how the pallet attachment of FIG. 8 attaches to a cargo pallet and an accessory in accordance with the disclosed embodiment

FIG. 8 illustrates an alternative embodiment of a pallet attachment 800 in accordance with the disclosed embodiments. Similar to pallet attachment 200, pallet attachment 800 also includes a first body portion 810 and a second body portion 820 that is stepped-down from the length direction of first body portion 810. First body portion 810 has a similar configuration of first body portion 210 of pallet attachment 200. That is, first body portion 810 includes a plurality of shoulder bolts 812 respectively located within a plurality of shoulder bolt recess areas 815, and each of the plurality of shoulder bolts 812 is inserted into a through hole 813 of shoulder bolt recess area 815. First body portion 810 is in a form of pocket-style with two side walls 816 on its width direction and has no bottom wall.

Second body portion 820, however, is different from second body portion 220. Instead of having attachment holes 222 as the attachment elements as shown in FIG. 2, second body portion 220 includes attachment protrusions 822 that protrude upwardly and the top of the protrusion 822 is no higher than top surface 814 of first body portion 810. The height of pallet attachment 800 may be larger than that of pallet attachment 200 so that attachment protrusions have enough height to penetrate tie-down rings 130 or attachment elements of accessories 300. The design of pallet attachment 800 is particularly advantageous for connecting two pallets to create a bridge interlocking of pallets for shipping. In this case, attachment protrusions 822 are suitable for penetrating tie-down rings 130 of pallet 100 so that pallet attachment 800 can interconnect two pallets with first body portion 810 placed on the top of rails 120 of a first pallet 100 and attachment protrusions 822 penetrates through tie-down ring from below of a second pallet 100. Further, the size of each protrusion 822 is chosen so that each protrusion 822 is able to penetrate through space 170 between two rails 120 of pallet 100 but not extend too much outside of tie-down rings 130.

Attachment protrusions 822 are also applicable to connect an accessory with attachment rings on its edges. FIG. 9 illustrates an exemplary embodiment in accordance with the disclosed embodiments showing that attachment protrusions 822 penetrate through attachment holes 902 of accessory 900 from below. The size of each attachment protrusion 822 is chosen to be able to penetrate through attachment holes 902 but not extend too much outside of attachment holes 902 to provide a smoother surface on the connection areas.

Figure 10:
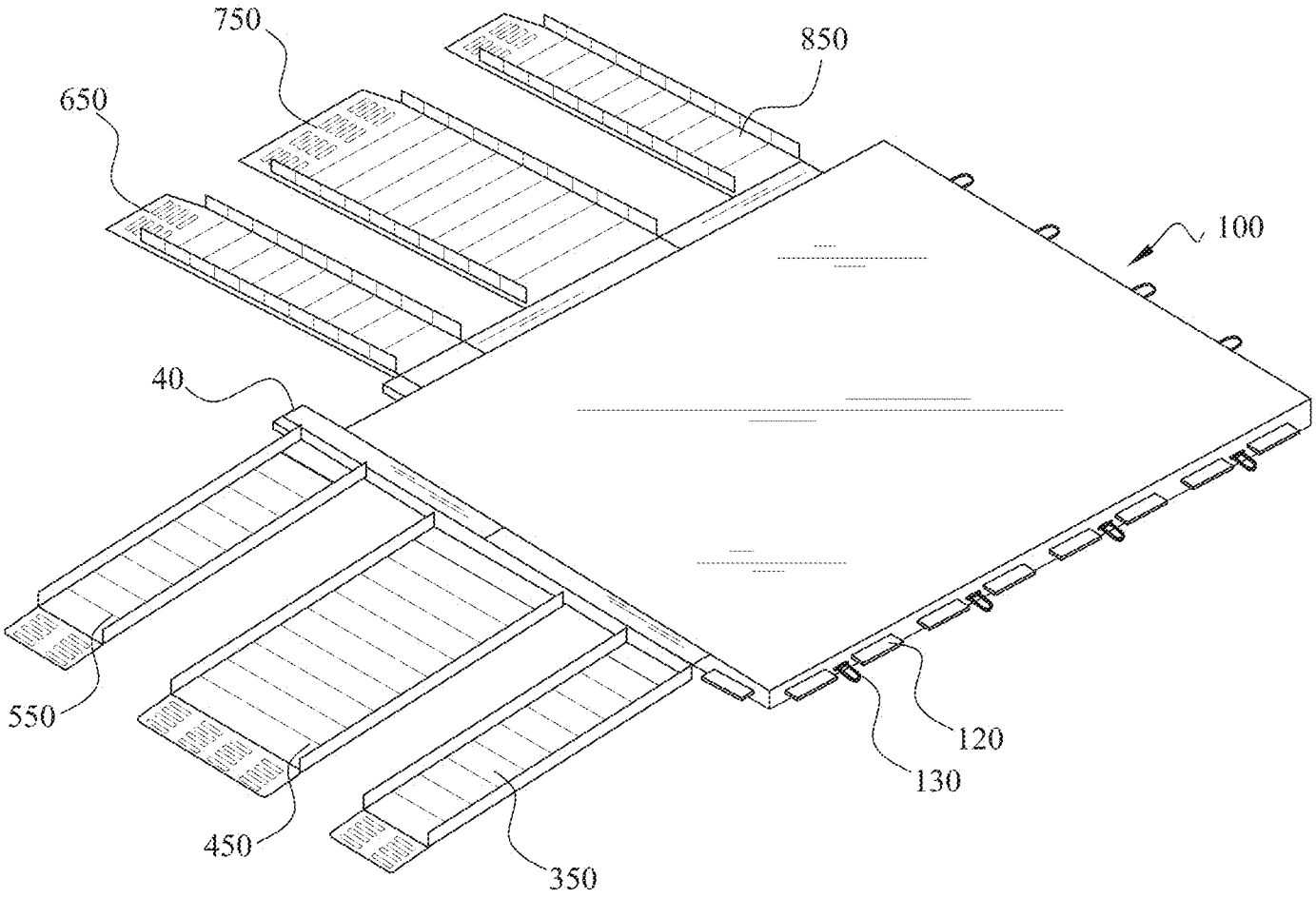
FIG. 10 illustrates a top view of an embodiment in which more than one ramp attachments are used to interconnect a pallet with multiple accessories.

FIG. 10 illustrates a top view of an embodiment in which more than one pallet attachment 200 are used to interconnect pallet 100 with multiple accessories. As shown, three accessories 350, 450, and 550 are attached one side of pallet 100, and three accessories 650, 750, and 850 are attached on another side of pallet 100. As seen, multiple attachments may be used and configured to engage multiple size accessories. In general, smaller accessories are desired as they are lighter in weight. Thus, an attachment that allows for flexible configuration with multiple attachments is beneficial.

As used in this specification and the appended claims, the singular forms "a," "an," and "the" include plural forms thereof unless the context clearly indicates otherwise. Unless otherwise indicated, all numbers expressing conditions, concentrations, dimensions, and so forth used in the specification and claims are to be understood as being modified in all instances by the term "about".

While various embodiments of the present disclosure have been disclosed, it will be apparent to those of ordinary skill in the art that many more embodiments and implementations are possible within the scope of the present disclosure. For example, the present disclosure as described herein includes several aspects and embodiments that include particular features. Although these features may be described individually, it is within the scope of the present disclosure that some or all of these features may be combined with any one of the aspects and remain within the scope of the present disclosure. Accordingly, the present disclosure is not to be restricted except in light of the attached claims and their equivalents.

We claim:

1. A pallet attachment for connecting a pallet and an accessory, comprising:

a first body portion adapted to rest on a top surface of at least one rail of the pallet, comprising, on a top surface thereof, at least one shoulder bolt located in one shoulder bolt recess for receiving and engaging with at least one pallet tie-down ring of the pallet, wherein the at least one shoulder bolt is penetrable through a bottom surface of the first body portion to contact with the top surface of the at least one rail of the pallet;

a second body portion that is a step-down ledge from the first body portion, having at least one attachment element adapted to receive an attaching part of the accessory; and wherein the at least one attachment element of the second body portion is an attachment hole, and the at least one attachment part of the accessory is a pin.

2. The pallet attachment of claim 1, wherein the first body portion includes at least two shoulder bolts, each of the shoulder bolts is capable of rotating down to contact the top surface of the at least one rail of the pallet.

3. The pallet attachment of claim 1, wherein when using to interconnect the pallet and the accessory, a bottom surface of the first body portion is placed on the top surface of the at least one rail of the pallet, and two corners of the bottom surface that are attached to the pallet are chamfered.

4. The pallet attachment of claim 1, wherein the at least one shoulder bolt is located under the at least one tie-down ring when the first body portion is placed on the top surface of the at least one rail of the pallet.

5. The pallet attachment of claim 4, wherein the at least one tie-down ring is engaged with the at least one shoulder bolt within the shoulder bolt recess for securing the at least one shoulder bolt on the top surface of the at least one rail of the pallet.

6. The pallet attachment of claim 1, wherein the top surface of the first body portion is substantially at a same level of a top surface of the pallet when the pallet attachment is resting on the top surface of the at least one rail of the pallet.

7. A pallet assembly, comprising:

a cargo pallet, comprising a platform and a plurality of rails on four sides of the platform, and a plurality of tie-down rings located between every other two rails; and a pallet attachment for attaching to the cargo pallet for locking and extending a pallet surface the pallet surface, the applet attachment comprising:

a top surface having at least one shoulder bolt recess and at least one shoulder bolt, each of at least one shoulder bolt recess has a flat bottom surface and a hole for receiving one of the at least one shoulder bolt, wherein the bottom surface of the at least one shoulder bolt recess is lower than the top surface, and wherein the at least one shoulder bolt recess and the at least shoulder bolt are used for receiving and engaging with at least one pallet tie-down ring included in the pallet; and and a step-down ledge having at least one attachment holes adapted to engage with at least one attachment element of an accessory;

wherein when in use, the pallet attachment is placed on a top surface of at least one of the plurality of rails of the pallet with the flat bottom surface of the at least one shoulder bolt recess sitting on the top surface of the at least one rail, and wherein the at least tie-down ring of the pallet is engaged with the at least one shoulder bolt for security; and wherein the at least one shoulder bolt is capable of rotating down to contact the top surface of the at least one of the plurality of rails of the pallet.

8. The pallet assembly of claim 7, wherein the at least one tie-down ring is engaged with the at least one shoulder bolt within the shoulder bolt recess for securing the at least one shoulder bolt on the top surface of the at least one of the plurality of rails of the pallet.

9. The pallet attachment of claim 7, wherein the top surface of the pallet attachment is substantially at a same level of a top surface of the cargo pallet and a top surface of the accessory when the pallet attachment is resting on the top surface of the at least one of the plurality of rails of the pallet and the at least one attachment element of the accessory is attached to the at least one attachment hole of the pallet attachment.

* * * * *